US005720051A

United States Patent [19]

Johnson

[11] Patent Number: 5,720,051

[45] Date of Patent: Feb. 24, 1998

[54] INFLATABLE MULTIPLE CELL HELMET LINER TO ENHANCE FIT, SECURITY AND COMFORT

[75] Inventor: David C. Johnson, Gilford, N.H.

[73] Assignee: The United States of America as represented by the Secretary of the Air Force, Washington, D.C.

[21] Appl. No.: 687,066

[22] Filed: Jul. 8, 1996

[51] Int. Cl.[6] ..... A42B 3/02

[52] U.S. Cl. ..... 2/413

[58] Field of Search ..... 2/413, 414, 417, 2/428, 410, 411, 6.1, DIG. 10

[56] References Cited

U.S. PATENT DOCUMENTS

| | | | |
|---|---|---|---|
| 2,618,780 | 11/1952 | Cushman | 2/413 |
| 3,668,704 | 6/1972 | Conroy et al. | 2/413 |
| 3,872,511 | 3/1975 | Nichols | 2/413 |
| 4,060,855 | 12/1977 | Rappleyea | 2/413 |
| 4,124,904 | 11/1978 | Matthes | 2/413 |
| 4,287,613 | 9/1981 | Schulz | 2/413 |
| 5,050,240 | 9/1991 | Sayre | 2/6 |
| 5,083,320 | 1/1992 | Halstead | 2/413 |
| 5,181,279 | 1/1993 | Ross | 2/413 |
| 5,263,203 | 11/1993 | Kraemer et al. | 2/413 |

*Primary Examiner*—Michael A. Neas

*Attorney, Agent, or Firm*—Fredric L. Sinder; Thomas L. Kundert

[57] ABSTRACT

A new inflatable liner for an aircraft or other protective helmet is disclosed. The liner includes a multiplicity of separate inflatable cells adjacently arranged in the general shape of a cap or of the inside of a helmet. Each inflatable cell includes a separate inflation tube. The inflation tubes extend out the back or side of the liner to one or more collector tubes. A valve controls a supply of inflatable fluid, typically pressurized air, to the collector tube. The inflation tubes may be grouped so that adjacent inflatable cells are differentially pressurized to provide impact energy absorption and so that inflatable cells on the sides of the helmet liner are more highly pressurized than cells on the top of the helmet liner to hold the helmet liner, and an accompanying helmet, more securely on a person's head.

9 Claims, 1 Drawing Sheet

INFLATABLE MULTIPLE CELL HELMET LINER TO ENHANCE FIT, SECURITY AND COMFORT

RIGHTS OF THE GOVERNMENT

The invention described herein may be manufactured and used by or for the Government of the United States for all governmental purposes without the payment of any royalty.

BACKGROUND OF THE INVENTION

The present invention relates generally to liners for protective helmets, and more specifically to an inflatable multiple cell helmet liner for aircraft helmets that provides a more comfortable fit and increased protection against head injuries than prior art helmet liners.

Pilots and other aircrew members flying highly agile aircraft endure a great deal of slippage of their helmets during maneuvers. Over a period of time, they can be distracted by ill-fitting or uncomfortable helmets. Helmet makers try to size helmets for a range of "normal" head sizes and thus fail to adequately fit all head sizes due to the variation of head shapes and sizes across the pilot population.

Aircraft helmets typically include layers of molded padding combined with separate liners. In addition to the primary function of providing protection, this combination of molded padding and separate liners is intended to accomplish two primary tasks: provide a better fit and make the helmet more comfortable. The separate liners are generally very slippery, do not form a good seal to the scalp or hair, and do not take into consideration the unique contours of an aircrew member's skull. When these liners are placed inside a conventional protective helmet, they contribute little to the fit of the helmet because they are made of a thin, silk-like material. Contour fit is provided solely by the inner foam padding of the helmet. The inner foam padding comes in various sizes, but does not include means for contouring itself to the shape of an aircrew member's skull. The only adjustment is a neck and nape strap by which fit is enhanced only by tightening the straps and forcing a better contour by a two point force (each strap attachment point), an inherently uncomfortable method.

The prior art has long sought to provide better fit and comfort for aircraft helmets, along with improved protection. One popular approach has been to add inflatable components to the inside of the helmets. These inflatable components include a helmet liner made of a pneumatically interconnected series of inflatable cells, a helmet liner made of a single inflatable bladder in the shape of the inside of the helmet, and even an apparatus for creating an unconfined cushion of air between helmet and head so that the helmet might float on the cushion of air over the head.

Unfortunately, these prior art attempts have not provided a complete solution to the problems of fit, comfort and protection. A particular problem has been that fit, comfort and protection is 25 compromised by the fact that all the inflatable regions between head and helmet are interconnected, affect and depend on, generally detrimentally, all other regions.

Thus it is seen that there is still a need for improved helmet liners that provide improved fit, comfort and protection for aircraft and other protective helmets.

It is, therefore, a principal object of the present invention to provide an inflatable helmet liner that substantially improves the fit, comfort and the protection of aircraft and other protective helmets.

It is a feature of the present invention that its inflatable cells are not pneumatically interconnected so that the pressure in each cell can individually vary to provide improved fit, comfort and protection over separate regions of a person's head.

It is an advantage of the present invention that its individually inflated cells can provide redundant protection in the event of an impact which punctures one or more cells.

It is another advantage of the present invention that its individually inflated cells can provide improved impact energy absorption.

It is a further advantage of the present invention that its individually inflated cells can provide improved comfort by reducing the amount of chin strap tension needed to hold a protective helmet on a person's head.

It is yet another advantage of the present invention that it will reduce the number of different sizes of helmets needed to fit the entire pilot population, thus saving money.

It is a still further advantage of the present invention that it is light weight and less bulky than liners capable of providing comparable levels of protection.

These and other objects, features and advantages of the present invention will become apparent as the description of certain representative embodiments proceeds.

SUMMARY OF THE INVENTION

The present invention provides a new inflatable liner for protective helmets. The breakthrough discovery of the present invention is that using a multiplicity of individually inflated cells provides improved fit, comfort and protection over prior art inflatable helmet liners. In particular, that the cells are not pneumatically interconnected makes possible varying the inflation pressure among different cells over the surface of a persons head which feature can be used to provide increased impact energy absorption and better fit.

Accordingly, the present invention is directed to an inflatable liner for use with a protective helmet, comprising a multiplicity of inflatable cells adjacently arranged in the general shape of the inside of the protective helmet and a multiplicity of inflation conduits for supplying fluid to the inflatable cells, each inflation conduit having a first end connected to a corresponding individual inflatable cell and a second end extending out from the inflatable liner. The invention may further comprise a collector conduit into which inflation conduit second ends connect. The inflation conduits may be divided into a plurality of groups of inflation conduits, wherein the groups of inflation conduits are defined such that adjacent inflatable cells are, to the largest possible topological extent, connected to inflation conduits in different groups. The inflation conduits may also be divided into a plurality of groups of inflation conduits, wherein the groups of inflation conduits are defined such that inflatable cells at the sides of the liner are connected to inflation conduits in different groups from inflatable cells at the top of the liner. The inflation conduits may also be divided into a plurality of groups of inflation conduits, further comprising a plurality of corresponding collector conduits equal in number to the number of groups of inflation conduits, such that all the inflation conduit second ends of each group of inflation conduits connect to a corresponding collector conduit for that group of inflation conduits. The groups of inflation conduits may also be defined such that adjacent inflatable cells are, to the largest possible topological extent, connected to different collector conduits. The groups of inflation conduits may also be defined such that inflatable cells at the sides of the liner are connected to different collector conduits from inflatable cells at the top of the liner. The inflatable liner may further comprise a plurality of supplies of pressurized air, wherein a collector conduit connected to inflation conduits connected to inflatable cells at the sides of the liner are connected to at least one supply of pressurized air at a higher pressure than any supply of pressurized air to which is connected a collector conduit connected to inflatable cells at the top of the liner.

The present invention is also directed to a method for improving the fit, comfort and protection of a protective helmet, comprising the steps of providing a multiplicity of inflatable cells adjacently arranged in the general shape of the inside of the protective helmet, providing a multiplicity of inflation conduits for supplying fluid to the inflatable cells, each inflation conduit having a first end connected to a corresponding individual inflatable cell and a second end extending out from the inflatable liner, the inflation conduits being divided into a plurality of groups of inflation conduits, wherein the groups of inflation conduits are defined such that inflatable cells at the sides of the liner are connected to inflation conduits in different groups from inflatable cells at the top of the liner, and supplying pressurized air to the groups of inflation conduits, wherein the pressurized air supplied to a group of inflation conduits connected to inflatable cells at the top of the liner is supplied at a lower pressure than pressurized air supplied to a group of inflation conduits connected to inflatable cells at the sides of the liner.

The present invention is further directed to a method for improving the fit, comfort and protection of a protective helmet, comprising the steps of providing a multiplicity of inflatable cells adjacently arranged in the general shape of the inside of the protective helmet, providing a multiplicity of inflation conduits for supplying fluid to the inflatable cells, each inflation conduit having a first end connected to a corresponding individual inflatable cell and a second end extending out from 25 the inflatable liner, wherein the inflation conduits are divided into a plurality of groups of inflation conduits and wherein the groups of inflation conduits are defined such that inflatable cells at the sides of the liner are connected to a different collector conduit from a collector conduit connected to inflatable cells at the top of the liner, providing a plurality of corresponding collector conduits equal in number to the number of groups of inflation conduits, such that all the inflation conduit second ends of each group of inflation conduits connect to a corresponding collector conduit for that group of inflation conduits, and supplying pressurized air to the collector conduits, wherein the pressurized air supplied to a collector conduit connected to groups of inflation conduits connected to inflatable cells at the top of the liner is supplied at a lower pressure than pressurized air supplied to a collector conduit connected to groups of inflation conduits connected to inflatable cells at the sides of the liner.

The present invention is yet also directed to a method for improving the fit, comfort and protection of a protective helmet, comprising the steps of providing a multiplicity of inflatable cells adjacently arranged in the general shape of the inside of the protective helmet, providing a multiplicity of inflation conduits for supplying fluid to the inflatable cells, each inflation conduit having a first end connected to a corresponding individual inflatable cell and a second end extending out from the inflatable liner, wherein the inflation conduits are divided into a plurality of groups of inflation conduits and wherein the groups of inflation conduits are defined such that adjacent inflatable cells are, to the largest possible extent, connected to different groups of inflation conduits, and supplying pressurized air to the different groups of inflation conduits at different pressures such that, to the largest possible extent, adjacent inflatable cells are at different pressures.

BRIEF DESCRIPTION OF THE DRAWINGS

The present invention will be more clearly understood from a reading of the following detailed description in conjunction with the accompanying drawings wherein.

DETAILED DESCRIPTION

Figure 1:
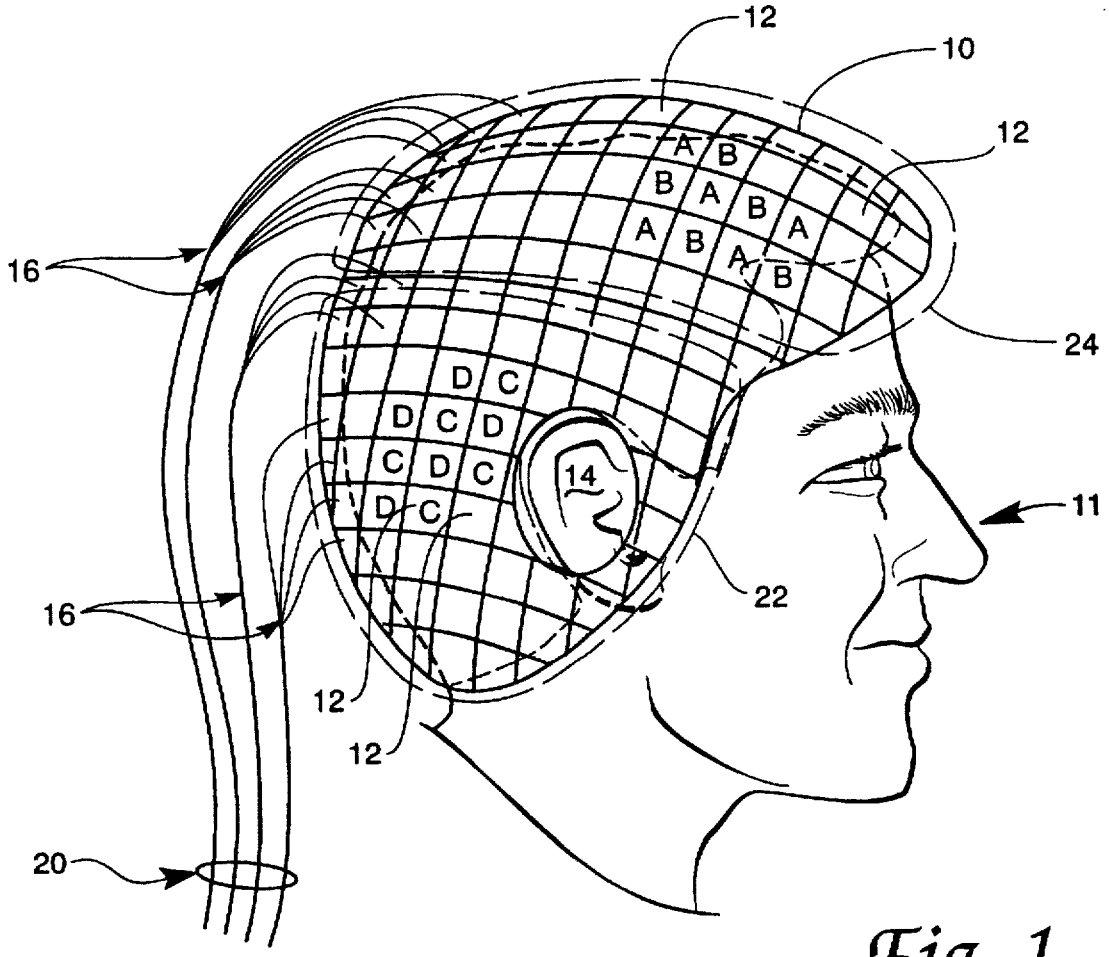
FIG. 1 is a perspective view of a multiple cell helmet liner made according to the teachings of the present invention; and, FIG. 2 is a perspective view of inflation tubes or lines leading from the inflatable cells of the helmet liner of FIG. 1 and connecting into collector tubes leading to sources of pressurized air.
Figure 2:
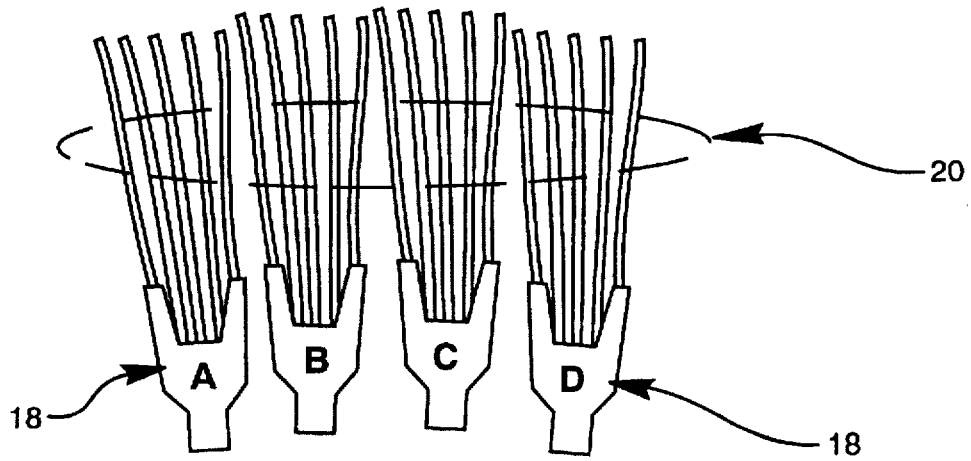

Referring now to FIG. 1 of the drawings, there is shown a perspective view of a multiple cell helmet liner 10 made according to the teachings of the present invention. Helmet liner 10 includes a multiplicity of inflatable cells 12 adjacently arranged in a cap-like shape to fit the inside of a protective helmet between the protective helmet and a human head 11. The number of cells 12 will typically be 50–200 and are preferably each about 1 inch square. Liner 10 optionally includes ear openings 14. Each cell 12 is connected to a separate inflation tube, line or conduit, 16 for supplying air or other fluid to the cell. Inflation tubes 16 extend to the back or side of liner 10 where they are collected into one or more collector tubes, or conduits, 18, as shown in FIG. 2. Collector tubes 18 lead to one or more sources of pressurized air. A valve 20, shown schematically in these figures as a simple clamping device, may be located either before, as shown here, or after inflation tubes 16 enter collector tubes 18.

The surfaces of inflatable cells 12 are preferably sprayed or covered with a high coefficient of friction material to reduce the possibility of relative motion between liner and helmet and between liner and head.

The first advantage of a helmet liner made according to the teachings of the present invention is redundancy. If any one of inflatable cells 12 is punctured, the remaining cells remain inflated and continue to provide both protection and comfort.

Because inflatable cells 12 are not pneumatically interconnected, they can be individually inflated to different pressures for a variety of advantageous results. For example, if tubes 12 are combined into separate groups of inflation tubes and connected, in this embodiment through separate collector tubes 16 labeled A and B, to sources of pressurized air at different pressures, such that adjacent cells A and B are, to the largest extent topologically possible, at different pressures, helmet liner 10 is then able to progressively absorb impact energy, thus enhancing the protection provided by the helmet and reducing the possibility of injury.

The advantages of individual inflation can be taken further. If tubes 16 are combined into separate groups of tubes and connected, in this embodiment through separate collector tubes 16 labeled A, B, C and D, such that inflatable cells 12 labeled C and D are inflated to a greater pressure than inflatable cells 12 labeled A and B, the security of the fit of the helmet is greatly increased. Older helmets which obtain most of their head holding forces from chin straps are notoriously uncomfortable. The opportunity to unhook a tight chin strap and relax is a much looked forward to event for an aircraft pilot. Other helmets, such as modern motorcycle helmets, reduce the amount of chin strap tension required to hold the helmet on a person's head by contouring the inside of the helmet close to the shape of the sides of a head so that removal of such a helmet requires spreading apart the bottom of the helmet. This contour fitting removes most of the needed chin strap tension, and converts much of the chin strap tension from a vertical force pulling against the head to a horizontal force helping to hold the shape of the helmet. By differentially pressurizing cells C and D, located on the sides 22 of liner 10, to a higher pressure than cells A and B, located at the top 24 of liner 10, cells C and D help hold the helmet more securely than would be possible with more uniformly pressurized inflatable helmet liners. The cells on the sides and top of a liner may also be made different sizes to enhance this, or other similar, effects.

Those with skill in the art of the invention will see that the described collecting tubes are only one way in which to connect supplies of pressurized air, or other fluid, to the inflatable cells. As such, while in most cases they will be a practical component of a helmet liner made according to the teachings of the present invention, they are not a critical element of any such helmet liner and are understood to be merely representative of any such collector.

The disclosed liner successfully demonstrates that the advantages of pneumatically separating the inflatable elements of an inflatable helmet liner. Although the disclosed liner is specialized, its teachings will find application in other areas where the interaction among various system components reduces the performance of the entire system and where allowing system components to act independently will increase performance by making possible new system features.

Those with skill in the art will readily see other possible advantages made possible by now being able to vary pressure among the inflatable cells in a helmet liner made according to the teachings of the present invention. For example, a greater number of inflatable cell groupings than the four described can be made to provide additional advantageous functions. Therefore, all embodiments contemplated have not been shown in complete detail. Other embodiments may be developed without departing from the spirit of the invention or from the scope of the claims.

I claim:

1. An inflatable liner for use with a protective helmet, comprising:

(a) a multiplicity of inflatable cells adjacently arranged in the general shape of the inside of the protective helmet; and, (b) a multiplicity of inflation conduits for supplying fluid to the inflatable cells, each inflation conduit having a first end connected to a corresponding individual inflatable cell and a second end extending out from the inflatable liner;

(c) the inflation conduits being divided into a plurality of groups of inflation conduits, wherein the groups of inflation conduits are defined such that adjacent inflatable cells are, to the largest possible topological extent, connected to inflation conduits in different groups.

2. An inflatable liner for use with a protective helmet, comprising:

(a) a multiplicity of inflatable cells adjacently arranged in the general shape of the inside of the protective helmet; and, (b) a multiplicity of inflation conduits for supplying fluid to the inflatable cells, each inflation conduit having a first end connected to a corresponding individual inflatable cell and a second end extending out from the inflatable liner;

(c) the inflation conduits being divided into a plurality of groups of inflation conduits, wherein the groups of inflation conduits are defined such that inflatable cells at the sides of the liner are connected to inflation conduits in different groups from inflatable cells at the top of the liner.

3. An inflatable liner for use with a protective helmet, comprising:

(a) a multiplicity of inflatable cells adjacently arranged in the general shape of the inside of the protective helmet; and, (b) a multiplicity of inflation conduits for supplying fluid to the inflatable cells, each inflation conduit having a first end connected to a corresponding individual inflatable cell and a second end extending out from the inflatable liner;

(c) the inflation conduits being divided into a plurality of groups of inflation conduits, further comprising a plurality of corresponding collector conduits equal in number to the number of groups of inflation conduits, such that all the inflation conduit second ends of each group of inflation conduits connect to a corresponding collector conduit for that group of inflation conduits.

4. The inflatable liner according to claim 3, wherein the groups of inflation conduits are defined such that adjacent inflatable cells are, to the largest possible topological extent, connected to different collector conduits.

5. The inflatable liner according to claim 3, wherein the groups of inflation conduits are defined such that inflatable cells at the sides of the liner are connected to different collector conduits from inflatable cells at the top of the liner.

6. The inflatable liner according to claim 5, further comprising a plurality of supplies of pressurized air, wherein a collector conduit connected to inflation conduits connected to inflatable cells at the sides of the liner are connected to at least one supply of pressurized air at a higher pressure than any supply of pressurized air to which is connected a collector conduit connected to inflatable cells at the top of the liner.

7. A method for improving the fit, comfort and protection of a protective helmet, comprising the steps of:

(a) providing a multiplicity of inflatable cells adjacently arranged in the general shape of the inside of the protective helmet;

(b) providing a multiplicity of inflation conduits for supplying fluid to the inflatable cells, each inflation conduit having a first end connected to a corresponding individual inflatable cell and a second end extending out from the inflatable liner, the inflation conduits being divided into a plurality of groups of inflation conduits, wherein the groups of inflation conduits are defined such that inflatable cells at the sides of the liner are connected to inflation conduits in different groups from inflatable cells at the top of the liner; and, (c) supplying pressurized air to the groups of inflation conduits, wherein the pressurized air supplied to a group of inflation conduits connected to inflatable cells at the top of the liner is supplied at a lower pressure than pressurized air supplied to a group of inflation conduits connected to inflatable cells at the sides of the liner.

8. A method for improving the fit, comfort and protection of a protective helmet, comprising the steps of:

(a) providing a multiplicity of inflatable cells adjacently arranged in the general shape of the inside of the protective helmet;

(b) providing a multiplicity of inflation conduits for supplying fluid to the inflatable cells, each inflation conduit having a first end connected to a corresponding individual inflatable cell and a second end extending out from the inflatable liner, wherein the inflation conduits are divided into a plurality of groups of inflation conduits and wherein the groups of inflation conduits are defined such that inflatable cells at the sides of the liner are connected to a different collector conduit from a collector conduit connected to inflatable cells at the top of the liner;

(c) providing a plurality of corresponding collector conduits equal in number to the number of groups of inflation conduits, such that all the inflation conduit second ends of each group of inflation conduits connect to a corresponding collector conduit for that group of inflation conduits; and, (d) supplying pressurized air to the collector conduits, wherein the pressurized air supplied to a collector conduit connected to groups of inflation conduits connected to inflatable cells at the top of the liner is supplied at a lower pressure than pressurized air supplied to a collector conduit connected to groups of inflation conduits connected to inflatable cells at the sides of the liner.

9. A method for improving the fit, comfort and protection of a protective helmet, comprising the steps of:

(a) providing a multiplicity of inflatable cells adjacently arranged in the general shape of the inside of the protective helmet;

(b) providing a multiplicity of inflation conduits for supplying fluid to the inflatable cells, each inflation conduit having a first end connected to a corresponding individual inflatable cell and a second end extending out from the inflatable liner, wherein the inflation conduits are divided into a plurality of groups of inflation conduits and wherein the groups of inflation conduits are defined such that adjacent inflatable cells are, to the largest possible topological extent, connected to different groups of inflation conduits; and, (c) supplying pressurized air to the different groups of inflation conduits at different pressures such that, to the largest possible topological extent, adjacent inflatable cells are at different pressures.

* * * * *